US005578277A

United States Patent [19]

White et al.

[11] Patent Number: 5,578,277

[45] Date of Patent: Nov. 26, 1996

[54] MODULAR CATALYTIC CONVERTER AND MUFFLER FOR INTERNAL COMBUSTION ENGINE

[75] Inventors: Scott T. White; Aaron L. Smith, both of East Peoria; Daniel J. Learned; Randy N. Peterson, both of Peoria; William H. Lane, Chillicothe, all of Ill.

[73] Assignee: Caterpillar Inc., Peoria, Ill.

[21] Appl. No.: 544,365

[22] Filed: Oct. 17, 1995

Related U.S. Application Data

[63] Continuation of Ser. No. 265,284, Jun. 24, 1994, abandoned.

[51] Int. Cl.[6] ..... F01N 3/10

[52] U.S. Cl. ..... 422/180; 422/171; 422/176; 422/177; 422/190; 422/220; 422/221; 422/222; 422/179; 60/288; 60/299; 55/DIG. 30

[58] Field of Search ..... 422/171, 176, 422/177, 179, 180, 188–190, 196, 197, 220, 221, 222; 60/299, 288, 301; 55/DIG. 21, DIG. 30, 466

[56] References Cited

U.S. PATENT DOCUMENTS

| | | | |
|---|---|---|---|
| 3,290,876 | 12/1966 | Ernst | 60/29 |
| 3,445,196 | 5/1969 | Thomas | 422/171 |
| 3,698,875 | 10/1972 | Yamada | 422/171 |
| 4,094,645 | 6/1978 | Bailey | 422/180 |
| 4,248,833 | 2/1981 | Aoyama | 422/180 |
| 4,416,674 | 11/1983 | McMahon | 55/485 |
| 4,425,304 | 1/1984 | Kawata et al. | 422/171 |
| 4,628,689 | 12/1986 | Jourdan | 60/295 |
| 4,859,427 | 8/1989 | Konishi et al. | 422/159 |
| 4,866,932 | 9/1989 | Morita | 428/180 |
| 4,897,187 | 1/1990 | Rice | 210/137 |
| 5,016,438 | 5/1991 | Harris | 60/299 |
| 5,042,249 | 8/1991 | Erdmannsdoerfer | 422/180 |
| 5,043,147 | 8/1991 | Knight | 422/180 |
| 5,103,641 | 4/1992 | Maus et al. | 422/171 |
| 5,233,830 | 8/1993 | Takeshima et al. | 422/171 |
| 5,293,742 | 3/1994 | Gillingham et al. | 55/DIG. 30 |

FOREIGN PATENT DOCUMENTS 2260276 4/1993 United Kingdom .

*Primary Examiner*—Timothy McMahon
*Assistant Examiner*—Hien Tran
*Attorney, Agent, or Firm*—Mark D. Becker; Liell & McNeil

[57] ABSTRACT

A modular catalytic converter and muffler is used to purify exhaust from a relatively large diesel engine. The device includes various structural components that are mounted in the exhaust flow path within a housing having an inlet and an outlet. A plate mounted within the housing divides the housing into an inlet chamber and an outlet chamber. A plurality of catalytic converter sub-cans are mounted across the plate between the inlet chamber and the outlet chamber. A flow distributor is mounted within the housing upstream of the catalytic converter sub-cans. The flow distributor divides and directs a portion of the exhaust to each of the catalytic converter sub-cans. Some muffler structure is mounted within the housing between the catalytic converter sub-cans and the outlet in order to attenuate noise in the exhaust.

19 Claims, 5 Drawing Sheets

MODULAR CATALYTIC CONVERTER AND MUFFLER FOR INTERNAL COMBUSTION ENGINE

This is a file wrapper continuation of application Ser. No. 08/265,284, filed Jun. 24, 1994, now abandoned.

TECHNICAL FIELD

The invention relates generally to a catalytic converter for purifying combustion exhaust, and more particularly, to a modular catalytic converter for relatively large diesel engines.

BACKGROUND ART

The combustion products (exhaust) from internal combustion engines contain poisonous nitrogen oxide compounds (NOx) and unburned hydrocarbons that are harmful to the environment. In an effort to at least partially purify the exhaust of these undesirable substances, it is long been known to use catalytic converters mounted in the exhaust flow path from the engine. While the development of catalytic converters for the small engines of automobiles is somewhat developed, federal regulations are now also requiring the makers of relatively large diesel engines to significantly reduce the emission levels of both hydrocarbons and NOx compounds.

Reducing emission levels in large diesel engines presents a new set of problems not previously encountered in relation to smaller automobile engines. For instance, the porous ceramic substrates typically utilized in catalytic converters cannot easily be extruded in diameters greater than twelve inches. This diameter substrate is simply too small to accommodate the mass flow of exhaust from large diesel engines. One manufacturer of large diesel engines has approached this problem by encasing ten or more square ceramic substrates in a metal shell, resulting in an exhaust flow cross section through a compound catalytic converter of sufficient size to accommodate the increased exhaust from the diesel engine. Unfortunately, this approach to the problem of creating a catalytic converter with a sufficient flow area suffers from the drawback of being extremely difficult to manufacture in large numbers within acceptable tolerances. What is needed is a modular catalytic converter that is easy to manufacture, reduces emissions to a satisfactory level, and is easily serviceable during the life of the diesel engine.

Because of the large effective cross sectional area required of catalytic converters for large diesel engines, the exhaust flow must necessarily diverge before encountering the catalytic converter. It has long been known that any obstacle in the exhaust flow path, including catalytic converters or muffler structure, must necessarily increase back pressure on the engine. As a general rule, increased back pressure results in lower fuel efficiency, decreased performance and a more limited altitude range for any given engine. Since the exhaust flow from the engine must also necessarily diverge significantly in that portion of the muffler devoted to attenuating low frequency noise, the present invention contemplates the incorporation of muffler structure into the same housing as the catalytic converter. Thus, a combination catalytic converter and muffler in a single housing can result in less back pressure on the engine than would otherwise occur if two separate housings were utilized.

DISCLOSURE OF THE INVENTION

In accordance with one embodiment of the present invention, a combination catalytic converter/muffler comprises a housing having an inlet, an outlet, and an exhaust flow path from the inlet to the outlet. A flow distributor is mounted to the housing in the exhaust flow path downstream of the inlet. A plurality of catalytic converter substrates are mounted in the housing and arranged in parallel to one another in the exhaust flow path downstream of the flow distributor. The flow distributor includes a plurality of channels that divide the exhaust flow path into a plurality of sub-paths that reconverge downstream of the catalytic converter substrates. Finally, means for muffling sound in the exhaust is attached to the housing in the exhaust flow path upstream from the outlet.

In another embodiment of the present invention, a catalytic converter comprises a housing having an inlet, an outlet and an exhaust flow path from the inlet to the outlet. A plate mounted in the housing divides the housing into an inlet chamber and an outlet chamber. The plate also has a plurality of openings therethrough. A plurality of catalytic converter substrates are mounted parallel to one another in the openings.

One object of the present invention is to purify the exhaust from large diesel engines without undermining performance.

Another object of the present invention is to provide a catalytic converter which can be easily serviced during the life of the engine.

Still another object of the present invention is to provide a catalytic converter which is easily manufactured in large quantities within acceptable tolerances.

Still another object of the present invention is to provide an improved catalytic converter and muffler unit for internal combustion engines.

BEST MODE FOR CARRYING OUT THE INVENTION

Figure 1:
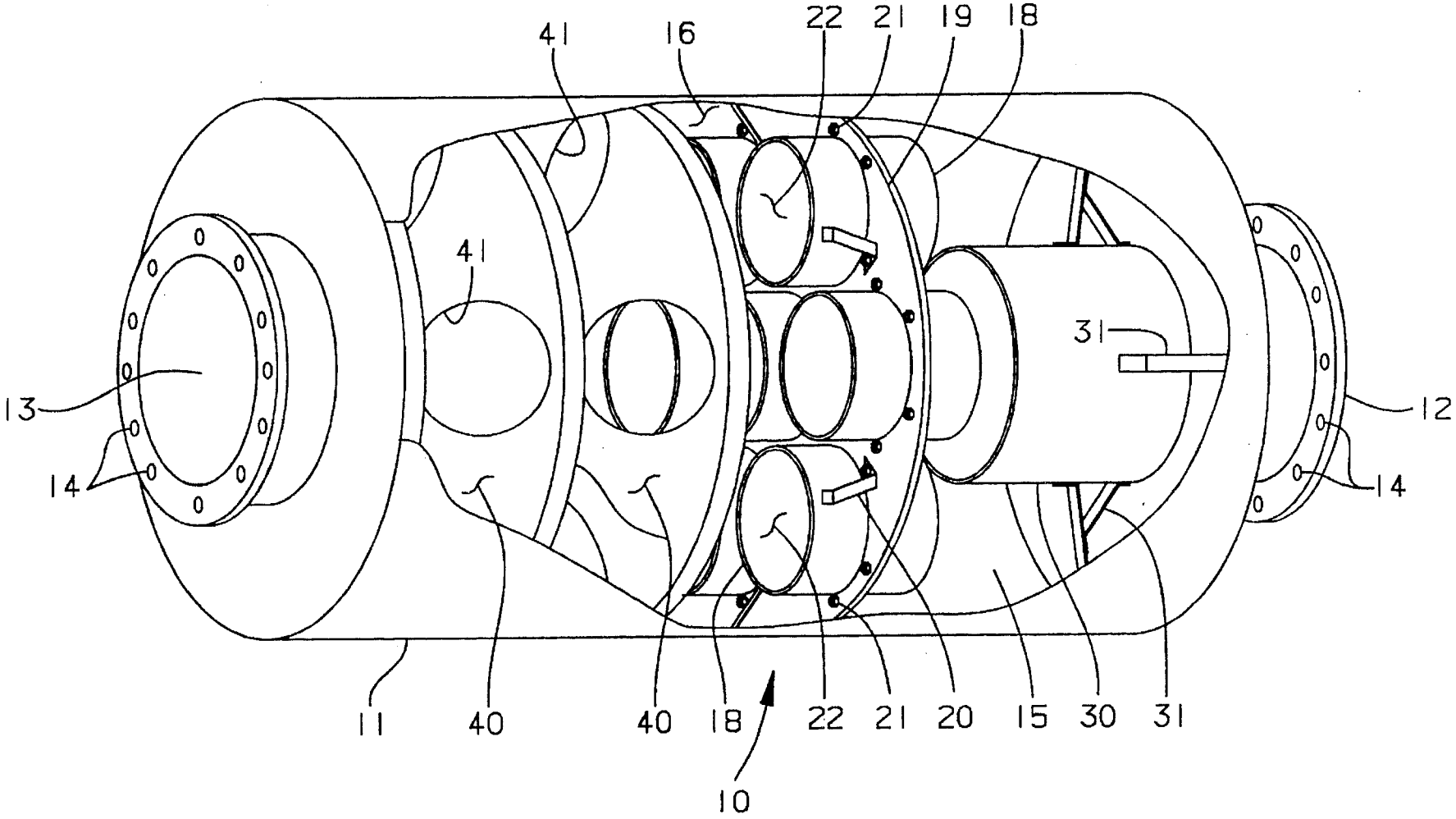
FIG. 1 is a side perspective view of a catalytic converter and muffler according to one embodiment of the present invention. A portion of the housing is shown removed in order to reveal the inner structure of the invention.

Referring now to FIG. 1, a modular catalytic converter and muffler 10 according to one embodiment of the present invention includes a cylindrical housing 11. Housing 11 is preferably on the order of 36 or more inches in diameter, and is preferably manufactured from stainless steel of an appropriate thickness. The housing includes an inlet 12 that is connected in a conventional manner via bolt openings 14 to an exhaust pipe from an engine. Exhaust from the engine flows through housing 11 and exits at outlet 13, which is likewise connected to an exhaust pipe utilizing bolt openings 14 in the flange. A one quarter inch thick stainless steel plate 19 is welded along its peripheral edge 17 (see FIG. 3) to the inner surface of housing 11. Plate 19 divides the housing into an inlet chamber 15 and an outlet chamber 16. In addition, plate 19 is attached to the inner surface of housing 11 via brackets 20 in an effort to limit vibrations in the plate due to the pulsing nature of the exhaust.

Figure 3:
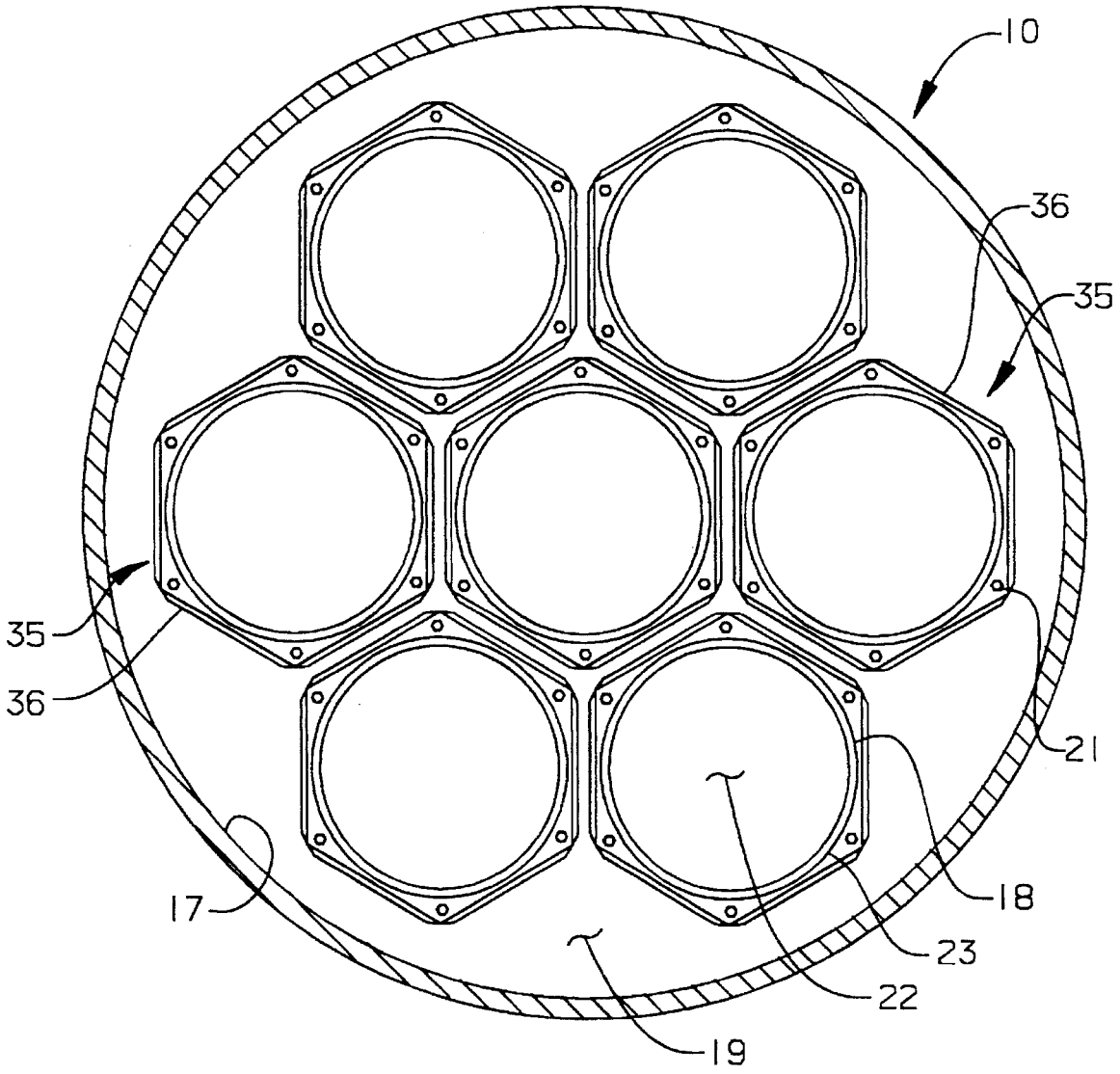
FIG. 3 is a sectioned front elevational view of the catalytic converter and muffler according to the present invention.

A plurality of tubular shaped sub-cans 18 are mounted in plate 19 so as to define a plurality of individual sub-paths from the inlet chamber 15 to the outlet chamber 16. The length of the exhaust path through each sub-can is substantially equal so that all the exhaust is exposed uniformly to the catalyst. In the preferred embodiment, seven sub-cans 18 are arranged in a hexagonal pattern as best shown in FIG. 3. Each sub-can 18 holds a cylindrically shaped ceramic substrate 22 having a desired catalytic coating thereon. Multiple catalytic converter substrates 22 are required in relation to relatively large diesel engines because current extrusion technology limits the size of the substrate to approximately twelve inches in diameter and a maximum length on the order of seven inches. Because of the limited extrusion length, for the ceramic substrates, in some applications two or more mounting plates are arranged within the housing in a series. Multiple mounting plates would result in a larger effective substrate length for those applications requiring more catalyst contact. Multiple mounting plates may also be desirable in those applications utilizing two different catalytic converter substrates, such as an oxidation catalyst and a deNOx catalyst, or for any other reason known in the art which renders multiple mounting plates desirable for a specific application.

Each substrate 22 is coated with a deNOx compound to promote the removal of poisonous nitrogen oxides from the exhaust. Substrates 22 are commercially available in a variety of sizes in both circular and square cross-sectional shapes from Corning and NGK Corporation. Although for illustration purposes substrate 22 is coated with a deNOx compound, it could likewise be coated with a variety of other compounds known in the art to help promote the removal of other undesirable compounds from the exhaust.

A flow distributor 30 is mounted within the housing upstream of sub-cans 18 via brackets 31. Flow distributor 30 is commercially available from known muffler manufacturers and serves to divide the exhaust entering inlet 12 and direct substantially equal portions of the exhaust to each of the seven sub-cans 18. In this way, substrates 22 age at approximately the same rate because each substrate treats approximately equal amounts of exhaust.

Although somewhat dependent upon the precise range of frequencies of sound needing attenuation, some muffler structure of a type well known in the art is mounted within exhaust chamber 16, preferably somewhere between sub-cans 18 and outlet 13. For illustrative purposes, FIG. 1 shows a pair of concave baffle plates 40 mounted within housing 11. Each baffle plate 40 includes a plurality of openings 41 which serve to muffle noise in the exhaust flow. In any event, it is desirable that the muffler structure be designed to attenuate noise without significantly increasing back pressure on the engine.

Exhaust enters the device at inlet 12 and is thereafter divided within flow distributor 30 and directed in substantially equal portions to each of the seven catalytic substrates 22. The exhaust then re-collects in outlet chamber 16 before flowing through the muffler structure 40 on its way to outlet 13. The present invention eliminates the need and undesirable effects of converging the flow between the catalytic converter and the muffler, which would otherwise be necessary for a catalytic converter mounted in a separate housing from the muffler. Flow convergence usually results in increased back pressure on the engine. In the present invention, the integration of the catalytic converter with the muffler in a single housing is accomplished with a minimum sacrifice in the performance of the diesel engine.

Figure 2:
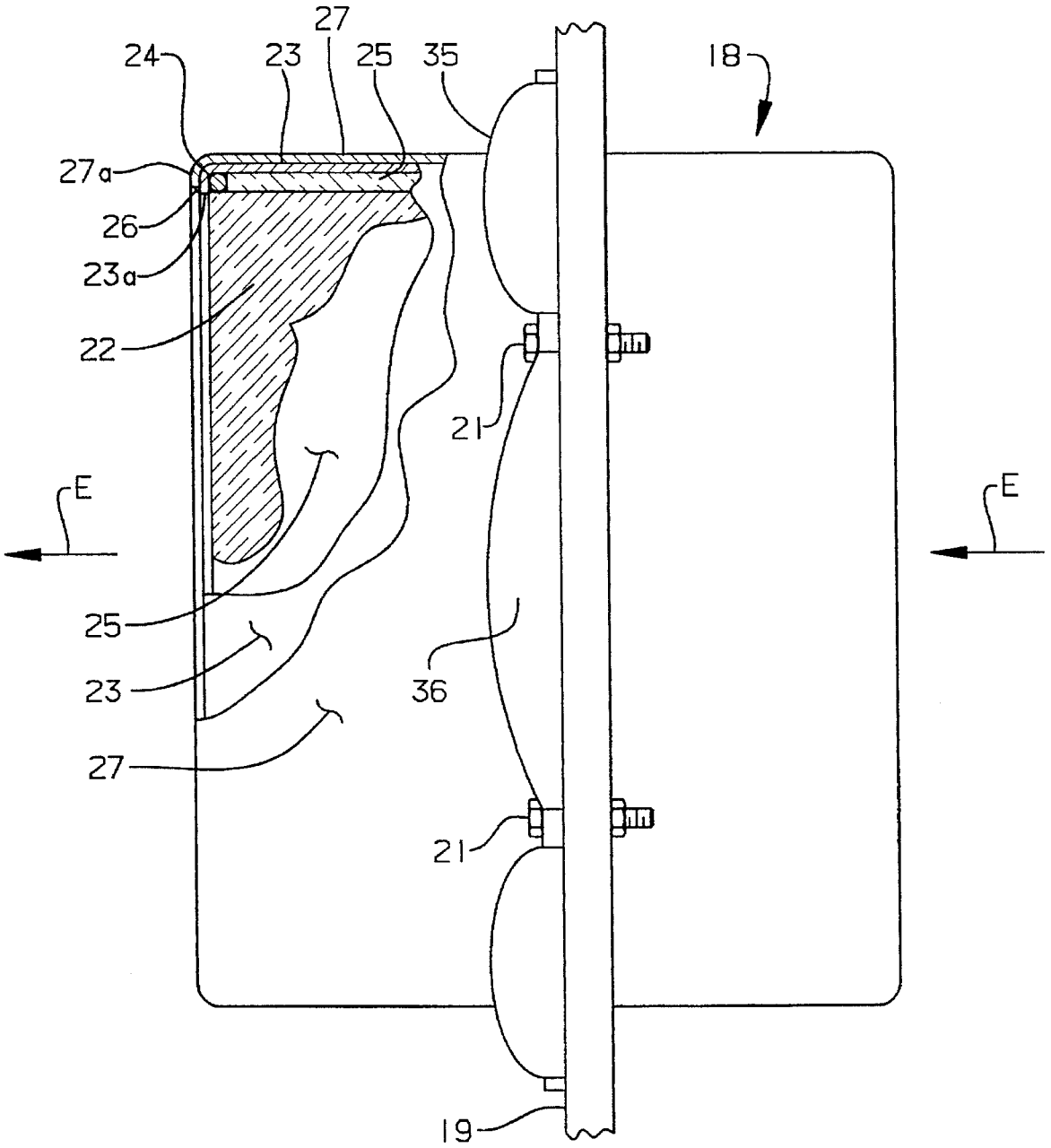
FIG. 2 is a partially sectioned side elevational view of a catalytic converter sub-can according to one aspect of the present invention.

Referring now to FIGS. 2 and 3, the detailed structure of the sub-cans 18 and the arrangement thereof is illustrated in greater detail. Each sub-can 18 is made from two layers of stainless steel approximately forty-five thousandths of an inch in thickness, with a length on the order of seven or more inches and a diameter on the order of eight or more inches. Each sub-can 18 is welded to a hex flange 35.

Each hex flange 35 is preferably stamped in a circle from flat sheet metal that includes a large circular opening through it's center. The diameter of the circular opening corresponds to the outer diameter of the sub-cans 18. The edges of each circular stamping are then bent upward to create a hexagonal shape, and then bolt holes are made at each apex of the upturned bends. Each hex flange 35 is secured to its respective sub-can 18 via a seam weld around the complete outer surface of the sub-can. The bolt holes in the hex flange allow each sub-can/hex flange unit to be removably attached to plate 19 via bolts 21. This permits each individual sub-can to be removed and replaced in regular service intervals during the life of the specific engine.

A cylindrically shaped ceramic substrate 22 is held within inner can 23 via inwardly turned flange **23*a*, which is typically on the order of 2–5 mm. Flange 23*a* effectively prevents the substrate 22 from escaping in the presence of a pulsing pressure gradient across plate 19. A matting material 25 is positioned between the outer surface of the substrate and the inner surface of inner can 23. Matting 25 is preferably made from a material, such as vermiculite, that expands under heat to further act to hold substrate 22 in place and prevent any leakage around the substrate. End rings 24 are positioned at each end of matting 25, and serve to shield the matting material 25 from the deteriorating effects of the exhaust flow. End rings 24 are preferably made from stainless steel wire mesh. Inner can 23 is placed within an outer can 27 which also includes an inwardly turned flange 27*a* so that a corner is generated permitting the inner can to be secured to the outer can via a perimeter weld 26. The curvature of outer flange 27*a* permits sub-can 18 to more easily be guided into its respective hole in plate 19 during normal servicing or installation. Furthermore, the thickness of outer can 27 permits hex flange 35 to be welded thereto via a perimeter weld without damaging matting material 25** due to excessive heat build up. The simple structure of each sub-can/hex flange structure allows them to be made relatively inexpensively in large numbers within acceptable tolerances.

In order to prevent exhaust leakage between flange 35 and plate 19, the portion of the flange between each bolt 21 must remain substantially stiff and unbowed even in the presence of exhaust pulsing pressure. Since there is a pressure differential across plate 19, there must necessarily be a bending moment on the flat and upturned portion 36 of the hex flange between each attachment bolt 21. The upturned portion 36 of each hex flange serves to stiffen the flange. This prevents exhaust leakage at the precise point where the bending moment produced by the pressure differential is the greatest. Thus, the hex flange structure prevents exhaust leakage past the catalytic substrates 22 and eliminates approximately half of the bolts that would otherwise be needed if a circular flange were utilized.

Not only do hex flanges 35 reduce the number of bolts required, they also permit a significantly denser packing of the sub-cans 18 themselves. In other words, circular flanges would require more bolts and require the sub-cans to be spread out over a larger area in order to get the same leakage protection. The consequence of this closer packing being that the diameter of housing 11 can be reduced without decreasing the effective catalytic cross-sectional area defined by the seven catalytic substrates 22.

Figure 4:
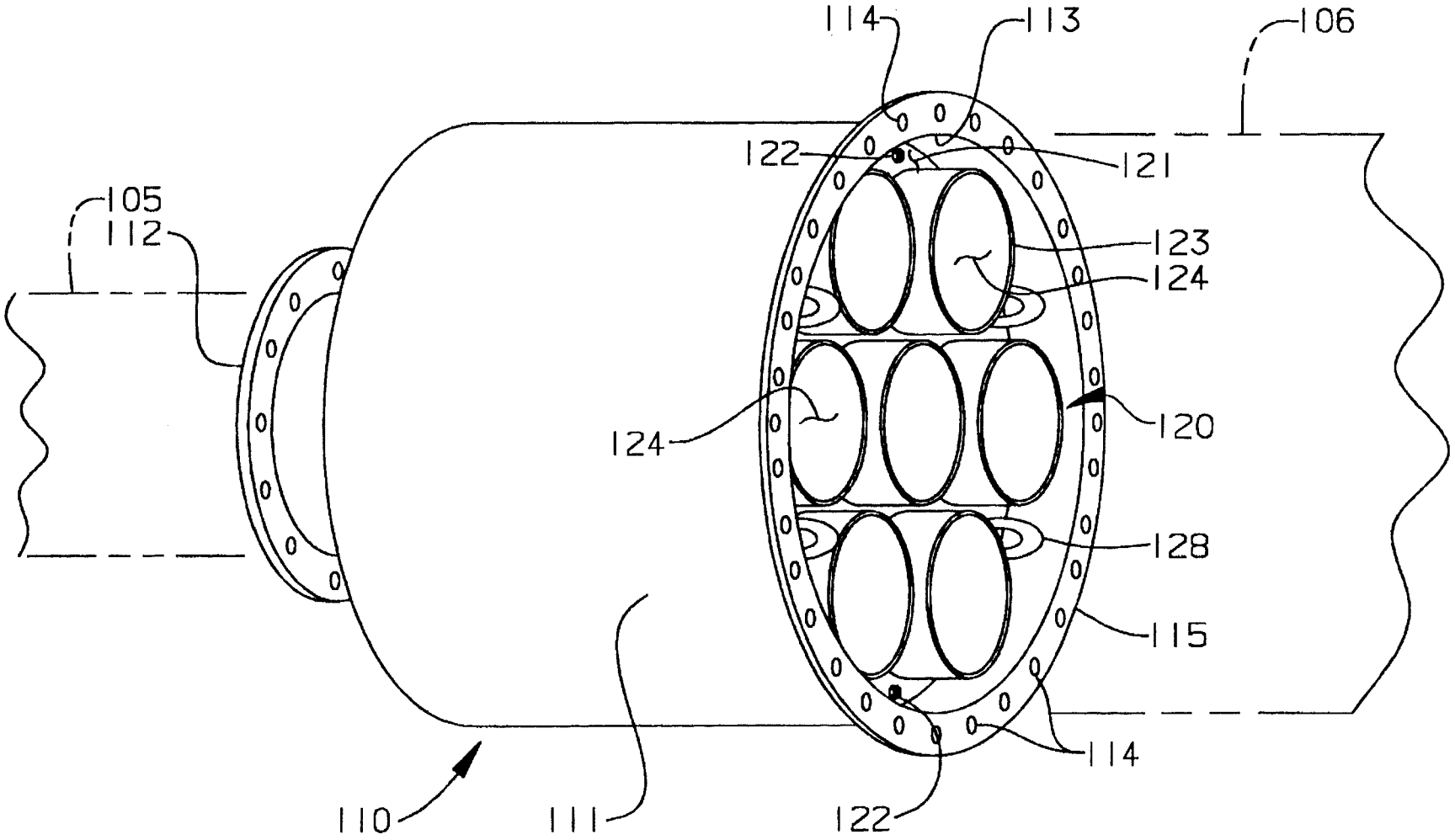
FIG. 4 is a side perspective view of a modular catalytic converter according to another embodiment of the present invention.
Figure 5:
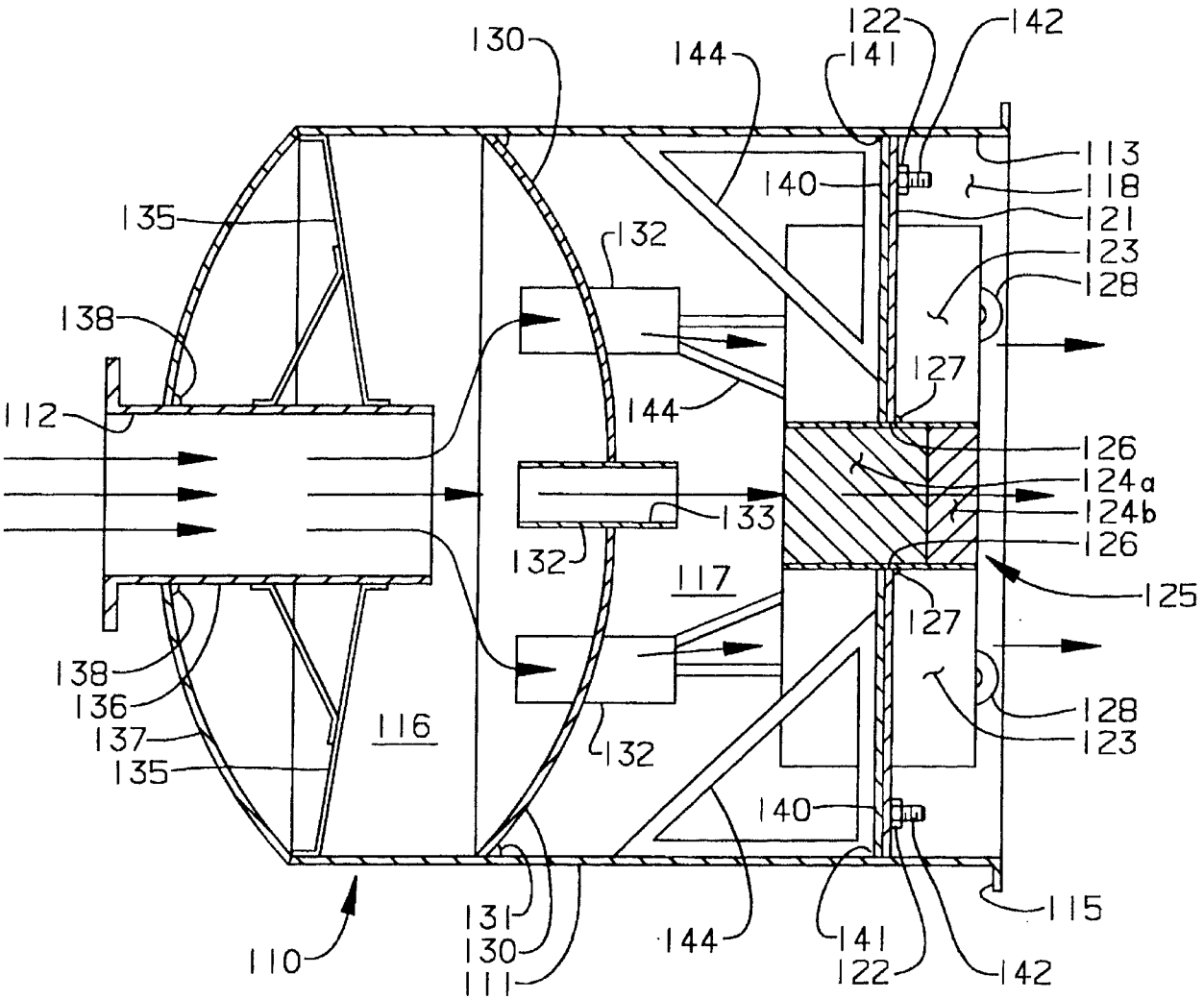
FIG. 5 is a sectioned side elevational view of the modular catalytic converter of FIG. 4.

Referring now to FIGS. 4 and 5, a modular catalytic converter 110 according to a second embodiment of the present invention includes a housing 111 having an inlet 112 and an outlet 113. Inlet 112 bolts to an exhaust pipe 105 from the engine in a conventional manner. This embodiment is different from the earlier embodiment in that outlet 113 bolts directly to a conventional muffler housing 106 via the bolt openings 114 in flange 115. Thus, housing 111 does not include a muffler portion as in the earlier embodiment; however, when catalytic converter 110 is bolted into the exhaust system, a compound housing, including housings 111 and 106, is created which like the earlier embodiment includes a catalytic converter section and a muffler section downstream thereof. This embodiment also differs from the earlier embodiment in that the various sub-cans 123 containing the catalyst substrates 124 are welded to a removable plate 121 as an assembly 120 instead of being individually bolted within the housing via the hex flanges 35 of the earlier embodiment.

As seen in FIG. 5, the interior of housing 111 is divided into a distributor chamber 116, an inlet chamber 117 and an outlet chamber 118. Inlet chamber 117 is separated from distributor chamber 116 by a convex dividing plate 130 that is attached within housing 111 via a peripheral weld 131. Inlet chamber 117 is separated from outlet chamber 118 by a fixed circular plate 140 that is permanently mounted within housing 111 via a perimeter weld 141 and a plurality of stiffeners 144. Exhaust entering catalytic converter 110 first collects within distributor chamber 116 and then passes into inlet chamber 117 via a plurality of tubular channels 132 mounted across convex plate 130. Channels 132 are metallic tubes mounted in openings in convex plate 130. Each channel 132 is mounted directly adjacent a corresponding sub-can 123 so that the exhaust is broken up in distributor chamber 116 so that equal portions of the exhaust are directed into each catalytic converter sub-can 123. Preferably, the centerline of each channel 132 is aligned with the centerline of its corresponding sub-can 123. After passing through sub-cans 123 the exhaust again collects in outlet chamber 118 on its way to encountering whatever muffler structure (not shown) is positioned in the adjacent muffler housing 106.

As shown in FIG. 4, the individual sub-cans 123 are arranged in a hexagonal pattern which has been found to be the best arrangement for producing the largest effective catalytic cross sectional area utilizing catalytic substrates 124 of a uniform diameter. It of course being understood that the present invention contemplates other sub-can arrangements and the possible use of sub-cans having different shapes, such as squares, and catalytic substrates of different shapes and sizes in a single unit. In any event, it is important that a large effective cross sectional area of catalytic substrates be created without wasting space so that the overall diameter of housing 111 is minimized.

As discussed earlier, this embodiment is different from the earlier embodiment in that a complete catalytic converter sub-assembly 120 is removably mounted within the housing 111 as opposed to the individual sub-cans 123 being removably bolted within the housing as in the earlier embodiment. In particular, the catalytic converter assembly includes a removable mounting plate 121 with an outer diameter just under that of the inner diameter of housing 111 in order to permit the removable plate 121 to be easily moved in and out of the housing. Removable plate 121 includes a plurality of openings 126 which correspond in diameter substantially to the outer diameter of sub-cans 123. Openings 126 are arranged in a hexagonal pattern and individual sub-cans 123 are welded across openings 126 via a perimeter weld 127. A plurality of lifting eye-bolts 128 are also attached to removable plate 121 in order to better facilitate lifting the catalytic converter assembly from the housing 111 during servicing. Eye-bolts 128 are necessary since the catalytic converter assembly can weigh as much as two hundred pounds or more. Finally, mounting removable plate 121 includes a plurality of peripheral bolt holes (not shown) that receive threaded studs 142 which are welded to fixed plate 140. Thus, the catalytic converter assembly 125 is mounted within housing 111 by aligning the upstream portion of sub-cans 123 with their corresponding openings in fixed plate 140, which at the same time aligns studs 142 with the bolt openings and mounting removable plate 121. The assembly is then secured within housing 111 via a plurality of bolts 122 which are threaded over studs 142. This feature of the invention permits the complete catalytic converter assembly 125 to be replaced at regular servicing intervals during the life of the particular engine to which the catalytic converter 110 is attached.

The distributor portion of this embodiment includes a convex end cap 137 within which is mounted an inlet tube 136 via a perimeter weld 138. End cap 137 is then welded to the cylindrical housing 111 via a perimeter weld in a conventional manner. A plurality of bracket stiffeners 135 are welded between the inner surface of housing 111 and the outer surface of inlet to 136. Since the exhaust can only pass from distributor chamber 116 to inlet chamber 117 through tubular channels 132, the accumulative cross section through the interiors 133 of channels 132 is at least as large as the cross sectional area of inlet tube 136 so that the distributor does not create any unnecessary back pressure on the engine. In this case, seven tubular channels 132 are included to correspond to the seven sub-cans 123 in the catalytic converter assembly 125.

Because of the inherent pulsing nature of exhaust from an internal combustion engine, fixed plate 140 is secured to housing 111 via a perimeter weld 141 and stiffened by a plurality of triangular stiffeners 144 which are welded both to the inner surface of housing 111 and to the upstream face of fixed plate 140. Stiffeners 144 serve to inhibit the introduction of vibrations in fixed plate 140 which could otherwise damage and severely limit the life of the fixed mounting plate 140. Thus, stiffeners 144 prevent fixed plate 140 from behaving as a drum in the presence of pulsing exhaust so that the mounting plate and catalytic substrates 124 are not destroyed by vibrations.

It should be clear that various modifications can be made to the present invention as herein above described and many apparently different embodiments of the same can be made without departing from the legal scope of the invention. For instance, the catalytic substrate material could be ceramic or metallic, and the catalyst coating on the substrate could include either alumna, titania, or silica coating having a precious metal such as palladium or platinum impregnated into the coating. Furthermore, the first embodiment of the invention describes the use of a single catalytic substrate 22, whereas the second embodiment of the invention illustrates the use of two or more serially arranged catalytic substrates 124*a* and 124*b* within each sub-can 123. In the latter case, each of the two or more catalytic substrates would be intended to remove different pollutant compounds from the exhaust. For instance, one substrate might utilize a deNOx catalyst where the second substrate may be directed to the removal of unburned hydrocarbons from the exhaust. In any event, it is intended that the above description serve only to aid in the understanding of the invention and is not intended to limit the legal scope of the patent which is defined by the claims as set forth below.

I claim:

1. A modular catalytic converter and muffler for treating combustion exhaust comprising:

a housing having an inlet, an outlet and an exhaust flow path from said inlet to said outlet;

a flow distributor mounted to said housing in said flow path downstream of said inlet;

a plurality of tubular sub-cans with walls substantially impervious to combustion exhaust, mounted in said housing and arranged axially parallel to one another in said exhaust flow path downstream of said flow distributor;

at least one catalytic converter substrate mounted in each of said tubular sub-cans;

wherein said flow distributor includes a plurality of channels dividing said exhaust flow path into a plurality of sub paths that reconverge downstream of said catalytic converter substrates, said channels being sized to divide said combustion exhaust into substantially equal portions, and said channels being positioned so that each of said substantially equal portions are directed to a different one of said tubular sub-cans; and means, mounted within said housing in said exhaust flow path upstream from said outlet, for muffling sound in said combustion exhaust.

2. The modular catalytic converter and muffler of claim 1 wherein said tubular sub-cans are removably mounted in said housing.

3. The modular catalytic converter and muffler of claim 2 wherein each of said tubular sub-cans is removably attached to a plate; and said plate is mounted in said housing and divides said housing into an inlet chamber and an outlet chamber so that gases in said combustion exhaust passing from said inlet chamber to said outlet chamber must pass through one of said tubular sub-cans.

4. The modular catalytic converter and muffler of claim 1 wherein each of said tubular sub-cans includes a peripheral flange.

5. The modular catalytic converter and muffler of claim 4 wherein each of said sub-cans is removably attached to a plate via said peripheral flange; and said plate is mounted in said housing and divides said housing into an inlet chamber and an outlet chamber so that gases in said combustion exhaust passing from said inlet chamber to said outlet chamber must pass through one of said tubular sub-cans.

6. The modular catalytic converter and muffler of claim 5 wherein said plurality of sub-cans is seven sub-cans arranged in a hexagonal pattern.

7. The modular catalytic converter and muffler of claim 1, wherein said at least one catalytic converter substrate comprises a plurality of catalytic converter substrates arranged in a series; and wherein each of said plurality of catalytic converter substrates is coated with a different catalyst.

8. The modular catalytic converter and muffler of claim 7, wherein said plurality of catalytic converter substrates includes a first substrate coated with a DeNOX catalyst and a second substrate coated with a catalyst that promotes removal of unburned hydrocarbons from said combustion exhaust.

9. A modular catalytic converter and muffler for treating combustion exhaust comprising:

a housing having an inlet, an outlet and an exhaust flow path from said inlet to said outlet;

a flow distributor mounted to said housing in said flow path downstream of said inlet;

a plurality of tubular sub-cans with walls substantially impervious to combustion exhaust, mounted in said housing and arranged axially parallel to one another in, said exhaust flow path downstream of said flow distributor;

at least one catalytic converter substrate mounted in each of said tubular sub-cans;

wherein said flow distributor includes a plurality of channels dividing said exhaust flow path into a plurality of sub paths that reconverge downstream of said catalytic converter substrates; and means, mounted within said housing in said exhaust flow path upstream from said outlet, for muffling sound in said combustion exhaust;

wherein said tubular sub-cans are removably mounted in said housing;

wherein each of said tubular sub-cans is removably attached to a plate; and said plate is mounted in said housing and divides said housing into an inlet chamber and an outlet chamber so that gases in said combustion exhaust passing from said inlet chamber to said outlet chamber must pass through one of said tubular sub-cans; and wherein each of said tubular sub-cans is removably attached to said plate utilizing a hexflange.

10. A modular catalytic converter for treating combustion exhaust comprising:

a housing having an inlet, an outlet and an exhaust flow path from said inlet to said outlet;

a fixed plate mounted in said housing dividing said housing into an inlet chamber and an outlet chamber, said plate having a plurality of openings therethrough;

a flow distributor mounted to said housing in said flow path between said inlet and said fixed plate;

a plurality of tubular sub-cans with walls substantially impervious to combustion exhaust, mounted in said plurality of openings so that gases in said combustion exhaust passing from said inlet chamber to said outlet chamber must pass through one of said tubular sub-cans; and at least one catalytic converter substrate mounted in each of said tubular sub-cans; and wherein said flow distributor includes a plurality of channels dividing said exhaust flow path into a plurality of sub paths that reconverge downstream of said catalytic converter substrates, said channels being sized to divide said combustion exhaust into substantially equal portions, and said channels being positioned so that each of said substantially equal portions are directed to a different one of said tubular sub-cans.

11. The modular catalytic converter of claim 10 wherein said tubular sub-cans are removably mounted to said fixed plate.

12. The modular catalytic converter of claim 11 further comprising a removable plate having a plurality of openings therethrough;

wherein each of said tubular sub-cans is mounted across one of said plurality of openings in said removable plate; and said removable plate is removably attached to said fixed plate.

13. The modular catalytic converter of claim 12 wherein said tubular sub-cans are arranged in a hexagonal pattern.

14. The modular catalytic converter of claim 13 wherein each of said tubular sub-cans contains a plurality of catalytic converter substrates arranged in a series; and wherein each of said plurality of catalytic converter substrates is coated with a different catalyst.

15. The modular catalytic converter of claim 14 further comprising means, attached between said fixed plate and said housing, for stiffening said plate against pressure pulses in said combustion exhaust.

16. The modular catalytic converter of claim 9 wherein each of said tubular sub-cans has ends, and each of said ends includes an inwardly turned flange that prevents said at least one catalytic converter substrate from escaping therefrom.

17. The modular catalytic converter and muffler of claim 10, wherein said at least one catalytic converter substrate comprises a plurality of catalytic converter substrates arranged in a series; and wherein each of said plurality of catalytic converter substrates is coated with a different catalyst.

18. The modular catalytic converter of claim 17, wherein said plurality of catalytic converter substrates includes a first substrate coated with a DeNOX catalyst and a second substrate coated with a catalyst that promotes removal of unburned hydrocarbons from said combustion exhaust.

19. A modular catalytic converter for treating combustion exhaust comprising:

a housing having an inlet, an outlet and an exhaust flow path from said inlet to said outlet;

a fixed plate mounted in said housing dividing said housing into an inlet chamber and an outlet chamber, said plate having a plurality of openings therethrough;

a flow distributor mounted to said housing in said flow path between said inlet and said fixed plate;

a plurality of tubular sub-cans with walls substantially impervious to combustion exhaust, mounted in said plurality of openings so that gases in said combustion exhaust passing from said inlet chamber to said outlet chamber must pass through one of said tubular sub-cans; and at least one catalytic converter substrate mounted in each of said tubular sub-cans; and wherein each of said tubular sub-cans include a hex flange; and each of said sub-cans is removably mounted to said fixed plate via said hex flange.

* * * * *